US007153408B1

(12) United States Patent
Herdman et al.

(10) Patent No.: US 7,153,408 B1
(45) Date of Patent: Dec. 26, 2006

(54) COPPER ELECTROPLATING OF PRINTING CYLINDERS

(76) Inventors: Roderick D. Herdman, 3 Cedar Crescent Kingsbury, Tamworth, Staffordshire (GB) B78 2JQ; Trevor Pearson, 8 Cricketers Meadow Cradeley Heath, West Midlands (GB) B64 7HR ( * ) Notice: Subject to any disclaimer, the term of this patent is extended or adjusted under 35 U.S.C. 154(b) by 0 days.

(21) Appl. No.: 11/403,628

(22) Filed: Apr. 13, 2006

(51) Int. Cl.
*C25D 7/00* (2006.01)
*C25D 3/38* (2006.01)

(52) U.S. Cl. ..... 205/151; 205/296

(58) Field of Classification Search ..... 205/151, 205/296

See application file for complete search history.

(56) References Cited

U.S. PATENT DOCUMENTS 2,830,014 A * 4/1958 Haas et al. ..... 205/274
4,334,966 A 6/1982 Beach et al.
4,391,879 A 7/1983 Fabian et al.
4,450,486 A 5/1984 Buechler
4,781,801 A 11/1988 Frisby
4,812,219 A 3/1989 Sattrup et al.
5,417,841 A 5/1995 Frisby
6,348,979 B1 2/2002 Flannery et al.

* cited by examiner

*Primary Examiner*—Roy King
*Assistant Examiner*—William T. Leader
(74) *Attorney, Agent, or Firm*—Carmody & Torrance LLP

(57) ABSTRACT

The present invention is directed to an improved copper plating bath for depositing a copper layer onto a printing cylinder, the copper plating bath comprising: (a) a source of copper ions; (b) a source of methane sulphonate ions; (c) a source of chloride ions; (d) an organosulphur compound having the formula R—S—R'—$SO_3^-X^+$ or $X^+$—$O_3S$—R'—S—R—S—R'—$SO_3$—$X^+$, wherein R is alkyl, hydroxyalkyl or alkyl ether, R' is a $C_2$–$C_4$ alkyl group, and $X^+$ is a cation; and (e) a polyether compound and method of using the same. The copper plating bath produces a plating deposit that has a stable hardness and is free from self-annealing during high speed plating.

20 Claims, 1 Drawing Sheet

Comparative Polarisation Behaviour of Phosphorised Copper Anodes in Methanesulphonate and Sulphate Electrolytes.

Figure 1. Comparative Polarisation Behaviour of Phosphorised Copper Anodes in Methanesulphonate and Sulphate Electrolytes.
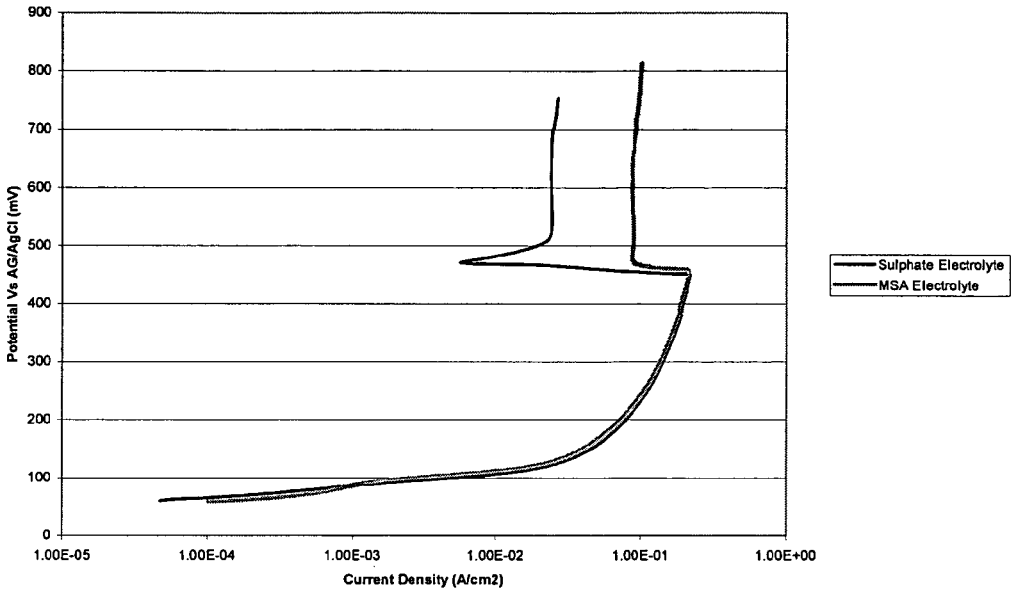

COPPER ELECTROPLATING OF PRINTING CYLINDERS

FIELD OF THE INVENTION

The present invention is directed to an improved method for depositing a copper layer to provide copper layer that has a stable hardness.

BACKGROUND OF THE INVENTION

Gravure printing is a method that uses the Intaglio process in which the image to be printed consists of depressions etched or engraved usually to different depths, on an engravable copper plated cylinder. Slightly viscous solvent inks are applied to the entire surface and a metal doctor blade removes the excess ink from the non-printing surface. In a typical process, engraving is performed on the copper plated cylinder, which is subsequently chrome plated to minimize wear.

In order to obtain a consistent quality of engraving, the hardness and crystal structure of the plated copper deposit is of paramount importance. Successful engraving is typically only obtained at a copper hardness of more than 200 Vickers Hardness (HV). At lower values, the engraved cell pattern loses definition. In addition, if the hardness of the deposit exceeds 240 HV, the lifetime of the diamond styli used to engrave the cylinders during electronic engraving may be reduced. Because of these factors, it is important to control the hardness of the plated copper deposits to within the desired range (200–240 HV).

By the use of suitable organic additives, it is possible to produce "as plated" copper deposits within this hardness range, but over time, the deposit "self-anneals" at room temperature and the hardness of the copper deposit falls to a value typically of between 140 and 170 HV. Annealing is the tendency of the hardness of the copper deposit to decrease with time as a result of changes in crystalline size, texture, microdeformations and dislocations within the copper deposit. Also, the depth of immersion of the cylinder during plating (i.e., partial immersion or full immersion) can affect the propensity of the deposit towards self-annealing.

Previously, a combination of organic additives has been used to produce a stable hardness in partially immersed cylinders, as described in U.S. Pat. No. 4,334,966 to Beach et al. and for fully immersed cylinders, the combination of additives described in U.S. Pat. No. 4,781,801 to Frisby has been used. Subsequent to these inventions, U.S. Pat. No. 5,417,841 to Frisby described a combination of an alkoxythio compound (consisting of alkoxylated thiodiglycol), and a sulphonated sulphurised hydrocarbyl compound to stabilised the hardness of copper deposited from both partially and completely immersed cylinders in copper sulphate based plating electrolytes. However, additional advancements are still needed to provide a copper plating deposit that has a suitable copper deposit.

Electronic engraving is a means of transferring an image for printing to a copper electroplated cylinder by directing a diamond-pointed stylus to form as many as 4,000 ink-receiving impressions every second. This technique requires copper deposits of very definite properties to prevent engraving defects and costly damage to the expensive equipment. It is essential that the deposited copper have a homogeneous fine-grained crystal structure that is free of nodulations and occlusions with excellent ductility and uniform hardness. A critical factor is the control and uniformity of hardness since the stylus pressures are set with references to a given Vickers hardness value and if this is not uniform over the entire surface, it will result in smearing or ripping of the deposit and badly defined impressions for printing. Examples of electronic engraving apparatus are described in U.S. Pat. No. 4,450,486 to Buechler and U.S. Pat. No. 6,348,979 to Flannery et al., the subject matter of each of which is herein incorporated by reference in its entirety.

Another potential problem in fabricating gravure and other printing cylinders is the difficulty in producing cylinders having surface properties that are identical from cylinder to cylinder. Surface defects such as roughness, pits or spots that are too hard or too soft, result in engraving errors and the subsequent need for repolishing and replating which can be both expensive and time consuming.

As discussed above, gravure printing cylinders may also be plated either partially or fully submerged, wherein the deposition rate is related to the immersion depth. An important advantage realized by increasing the immersion depth is a decrease in plating time, which has obvious economic advantages.

When a cylinder is plated partially immersed, i.e. to about 30% of its diameter, as compared to a cylinder that is plated totally submerged, the deposit characteristics are influenced by the fluctuations of the current and composition differences in the cathode film. In any event, plating baths are known to perform differently with respect to the immersion depth. The principal problem in this regard is annealing. This problem of recrystallization (annealing) can be characteristic of totally submerged cylinder operations when using a bath designed for partial immersion.

There remains a need in the art for an acid copper plating process which can be used to deposit a copper layer of uniform hardness and stability, which is suitable for electronic engraving, on rolls which are plated while partially submerged or completely or nearly completely submerged in the plating bath.

In addition to the requirement for stable hardness of copper deposit, it is an important requirement to plate the copper deposits as rapidly as possible. Copper sulphate based electrolytes have limitations as to the maximum rate of deposition due to limitations of solubility. Copper methanesulphonate is much more soluble than copper sulphate allowing higher copper concentrations in the electrolyte which in turn allows higher plating rates. A further limitation of sulphate based copper electrolytes is the maximum anode current density which may be applied. Above a certain threshold anodic current density, anode polarisation prevents effective operation of the process.

Methanesulphonate based electrolytes are much less prone to anode polarisation as is shown in FIG. 1. It can be seen from this FIGURE that in static conditions, phosphorised copper anodes will not sustain a continuous current of more than 2.4 $A/dm^2$ whereas in a methanesulphonate electrolyte, a continuous current of 8.7 $A/dm^2$ can be sustained. However, whereas plating from a methanesulphonate electrolyte has many advantages in terms of plating speed and resistance to anode polarisation, the problem of deposit self-annealing remains. In addition, the additive combination disclosed in U.S. Pat. No. 5,417,841 to Frisby does not prevent deposit self-annealing in methanesulphonate baths so additional improvements are still needed The present invention is directed to a method for producing copper deposits of stable hardness that are free from self-annealing, at high speed. The invention is particularly directed to the high speed application of copper to gravure cylinders. The invention is also usable in the high speed plating of copper in other applications where a deposit of stable hardness is required.

SUMMARY OF THE INVENTION

It is an object of the present invention to provide a copper plating bath that is capable of providing a copper plating deposit of stable hardness.

It is another object of the present invention to provide a copper plating bath that can produce a copper deposit of stable hardness that is free from self-annealing during plating at high speeds.

It is still another object of the present invention to provide a copper plating bath that can be used to plate both partially and fully immersed printing cylinders with good results.

To that end, in a first embodiment, the present invention is directed to a copper plating bath for depositing a copper layer onto a printing cylinder, the copper plating bath comprising:

a) a source of copper ions;
b) a source of methane sulphonate ions;
c) a source of chloride ions;
d) an organosulphur compound having the formula $R—S—R'—SO_3^-X^+$ or $X^+—O_3S—R'—S—R—S—R'—SO_3—X^+$, wherein R is alkyl, hydroxyalkyl or alkyl ether, R' is a $C_2$–$C_4$ alkyl group, and $X^+$ is a cation; and
e) a polyether compound.

In another embodiment, the present invention is directed to a method of depositing a copper layer onto a printing cylinder at a high speed to produce a copper deposit having a stable hardness, the method comprising the steps of:

a) providing a copper plating bath comprising:
   i) a source of copper ions;
   ii) a source of methane sulphonate ions;
   iii) a source of chloride ions;
   iv) an organosulphur compound having the formula $R—S—R'—SO_3^-X^+$ or $X^+—O_3S—R'—S—R—S—R'—SO_3—X^+$, wherein R is alkyl, hydroxyalkyl or alkyl ether, R' is a $C_2$–$C_4$ alkyl group, and $X^+$ is a cation; and
   v) a polyether compound;
b) immersing the printing cylinder in the copper plating bath; and
c) passing an electrical current through the copper plating bath while rotating the printing cylinder in the copper plating bath;

whereby copper is electrolytically deposited on the printing cylinder, said copper having a stable hardness.

BRIEF DESCRIPTION OF THE FIGURES

For a fuller understanding of the FIGURES, reference is had to the following description taken in connection with the accompanying FIGURE, in which:

FIG. 1 depicts a graph that compares the polarisation behaviour of phosphorised copper anodes in methanesulphonate and sulphate electrolytes

DETAILED DESCRIPTION OF THE PREFERRED EMBODIMENTS

The electroplating bath of the present invention includes copper ions, methanesulphonate ions and chloride ions. The inventors of the present invention have discovered that by including a compound having the formula $R—S—R'—SO_3^-$ in combination with polyethers and chloride ion in the bath and, preferably excluding compounds of the formula $H—S—R—SO_3^-$ or $R—S—S—R'—SO_3^-$, that a deposit of stable hardness can be produced from a methanesulphonate bath. The bath may also optionally contain organosulphur hardeners to further increase the hardness. The inventors of the present invention have also found that the combination of additives of the invention also works well in traditional sulphate based baths, such as those described in U.S. Pat. No. 5,417,841 to Frisby.

In a first embodiment, the present invention is directed to an improved method for depositing an electrolytic copper layer at high speed onto a printing cylinder, such as a rotogravure cylinder, the resulting deposit having a stable hardness that is suitable for high speed engraving. The present invention is also directed to the use of a unique plating bath formulation, which results in a surface coating that is ideally suited for electronic engraving.

In one embodiment, the present invention is directed to a copper plating bath for depositing a copper layer onto a printing cylinder, the copper plating bath comprising:

a) a source of copper ions;
b) a source of methane sulphonate ions;
c) a source of chloride ions;
d) an organosulphur compound having the formula $R—S—R'—SO_3^-X^+$ or $X^+—O_3S—R'—S—R—S—R''SO_3—X^+$, wherein R is alkyl, hydroxyalkyl or alkyl ether, R' is a $C_2$–$C_4$ alkyl group, and $X^+$ is a cation; and
e) a polyether compound.

Preferably, the source of copper ions is copper methane sulphonate although other sources of copper ions are also usable in the practice of the invention and would be known to one skilled in the art. The source of copper ions is typically used in the plating bath at a concentration of about 100–400 g/l, more preferably at a concentration of about 200–260 g/l. Copper methanesulphonate is easily manufactured by dissolving copper (II) oxide in methanesulphonic acid (although it may be manufactured by other routes—for example dissolving copper metal in methanesulphonic acid using an oxidising agent such as oxygen or hydrogen peroxide).

An amount of "free" methanesulphonic acid is also necessary for correct operation of the bath. This may be present in the bath at a concentration range of about 5–100 g/l, more preferably about 25–50 g/l. The source of methane sulphonate ions is preferably methane sulphonic acid (or a salt thereof).

The presence of chloride ions is also required in the bath. Without wishing to be bound by theory, it is believed that the presence of this ion is necessary to ensure even adsorption of the polyether component of the additive combination. Chloride ions should be present in the plating bath in a concentration range of 10–200 mg/l and preferably in the range of 50–100 mg/l. The source of chloride ions is preferably hydrochloric acid, although other sources of chloride ions are also usable in the practice of the invention and would be known to one skilled in the art.

The organosulphur compound is typically present in the bath composition at a concentration of about 5–500 mg/l. Cation $X^+$ is preferably selected from the group consisting of hydrogen, sodium, potassium, lithium, and combinations of one or more of the foregoing, and more preferably, $X^+$ is sodium. Examples of suitable organosulphur compounds include sodium 3-[(2-hydroxypropyl)sulfanyl]propane-1-sulphonate, sodium 3-(ethylsulfanyl)propane-1-sulphonate, sodium 3-[(2-hydroxyethyl)sulfanyl]propane-1-sulphonate, disodium 3,3'-(butane-1,4-diyldisulfanediyl)propane-1-sulphonate, and disodium 3,3-[oxybis(ethane-2,1-diylsulfanediyl)]dipropane-1-sulphonate, by way of example and not limitation.

The polyether compound is typically present in the bath composition at a concentration of about 5–5000 mg/l, preferably within the range of about 50–500 mg/l. In a preferred embodiment, the polyether has the formula $HO(CH_2CH_2O)_x(CH(CH_3)CH_2O)_y H$, wherein x is between 0 to 1000 and y is between 0 to 5000, with the proviso that both x and y cannot be 0, and if x=0, then y is between 3 and 12 and if y=0, x is between 10 and 1000. Preferably, the polyether is a block or random copolymer having a molecular weight of at least 1000. More preferably, the compound is a 50/50 random copolymer of ethylene and propylene oxide.

In one embodiment of the invention, the copper plating bath may also contain about 0.1 to 10 mg/l of a heterocyclic organosulphur compound. The heterocyclic organosulphur compound may be 2-imidazolinethione or 2-mercaptothiazoline, for example, although other heterocyclic organic sulphur compounds would also be known to those skilled in the art and would be usable in the practice of the present invention.

In another embodiment, the present invention is directed to a method of depositing a copper layer onto a printing cylinder at a high speed to produce a copper deposit having a stable hardness, the method comprising the steps of:

a) providing a copper plating bath comprising:
   i) a source of copper ions;
   ii) a source of methane sulphonate ions;
   iii) a source of chloride ions;
   iv) an organosulphur compound having the formula $R—S—R'—SO_3^-X^+$ or $X^+—O_3S—R'—S—R—S—R'—SO_3—X^+$, wherein R is alkyl, hydroxyalkyl or alkyl ether, R' is a $C_2$–$C_4$ alkyl group, and $X^+$ is a cation; and
   v) a polyether compound;
b) immersing the printing cylinder in the copper plating bath; and
c) passing an electrical current through the copper plating bath while rotating the printing cylinder in the copper plating bath;

whereby copper is deposited on the printing cylinder, said copper having a stable hardness.

In one embodiment, the printing cylinder is fully immersed in the copper plating bath. In an alternate embodiment, the printing cylinder is partially immersed in the copper plating bath to a depth of, for example to a depth of one third the diameter of the printing cylinder.

Preferably the plated deposit has a Vickers hardness of between about 200–240 HV.

The present method and composition produces copper coatings which have consistent hardness on storage. Furthermore, the plating may be carried out by either partial or complete immersion in the plating bath.

In order to realise the benefits of high speed deposition and freedom from anode polarisation which are available from methanesulphonate based copper electrolytes, it is necessary to maintain a balance of the additives mentioned above. This is to prevent self-annealing and produce a deposit of appropriate hardness.

The organosulphur compounds of the invention may be synthesised via different reaction routes. The preferred compounds may be prepared as in the following non-limiting examples:

Method 1

A reaction flask with mechanical stirrer, reflux condenser and temperature control is required. This preparation is for 100 g of a 60% w/w aqueous solution of sodium 3-[(2-hydroxypropyl)sulfanyl]propane-1-sulphonate.

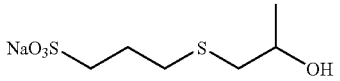

1. Charge the reaction flask with 37.2 g water.
2. Commence agitation and add 45.1 g of sodium 3-mercaptopropane-1-sulphonate (MPS).
3. Add 0.65 g 47% w/w sodium hydroxide and stir until the MPS is fully dissolved.
4. Heat the mixture to approximately 45° C. and turn off the heat.
5. Begin slow dropwise addition of 16.2 g propylene oxide. There will be an exotherm. Maintain the temperature in the range 50–60° C., the exotherm can be used to maintain the temperature but gentle heating may be used if required. Addition of all the propylene oxide may take several hours. Towards the end of the reaction the exotherm will subside and heating will be required.
6. When all of the propylene oxide is added, heat the mixture slowly to 65° C. and then hold for 1 hour.
7. Over 2–3 hours, raise the temperature to 100–105° C. to ensure complete reaction of the propylene oxide. During this time any reflux of propylene oxide should cease and water may begin to reflux. Hold at this temperature for 1 hour (the boiling point of the mixture is about 105° C.).
8. Cool to room temperature and neutralise the reaction mixture with methanesulphonic acid.

REFERENCE EXAMPLE A

A plating bath is prepared containing 250 g/l of copper methanesulphonate, 30 g/l of methanesulphonic acid and 80 mg/l of chloride ions (added as hydrochloric acid). To this bath was added 80 mg/l of an ethoxylated thiodiglycol (Lugalvan HS 1000 from BASF), 20 mg/l of Raschig SPS and 3 mg/l of 2-imidazolinethione. This is a combination of additives which produce deposits from a sulphate based electrolyte which do not self anneal (and are covered by U.S. Pat. No. 5,417,841).

From this electrolyte, a Hull cell test panel was produced by plating at 2 amps for 15 minutes. After plating, the hardness of the deposit was measured at 220 HV using a 50 g load. However, after heating the panel to 100 C for 1 hour, the deposit was found to have self-annealed to a hardness value of 164 HV (which would be too soft for engraving). When the test was repeated using the same concentrations of additives in a sulphate bath (210 g/l copper sulphate pentahydrate, 50 g/l sulphuric acid, 75 mg/l chloride), the hardness of the deposit was stable after heating to 100° C. (224 HV in both cases).

This example illustrates that existing additives are not suitable for use in methanesulphonate baths.

REFERENCE EXAMPLE B

A plating bath is prepared containing 210 g/l copper sulphate pentahydrate, 50 g/l sulphuric acid, 75 mg/l of chloride ions, 42 mg/l of the product manufactured in method 1 (25 mg/l of active material) and 100 mg/l of Breox 50-A-225 (a 50/50 random copolymer of ethylene oxide and propylene oxide with a molecular weight of approximately 1200). A test panel plated in this combination gave a hardness of 165 HV which did not self anneal on heating to 100° C. for 1 hour.

This example illustrates that additives of the invention disclosed in this patent may be used in sulphate electrolytes for the production of Gravure cylinders.

EXAMPLE 1

A plating bath is prepared containing 250 g/A of copper methanesulphonate, 30 g/l of methanesulphonic acid and 80 mg/l of chloride ions (added as hydrochloric acid). To this bath was added 42 mg/A of the product manufactured in method 1 (25 mg/l active material) and 100 mg/l of Breox 50-A-225. A test panel plated in this combination gave a hardness of 165 HV which did not self anneal on heating to 100° C. for 1 hour.

EXAMPLE 2

To the bath of example 1 was added 3 mg/l of 2-mercaptothiazoline. This gave a deposit with a hardness of 220 HV which did not self-anneal on heating to 100° C. for 1 hour.

EXAMPLE 3

A compound having the following structure:

sodium 3-(ethylsulfanyl)propane-1-sulphonate

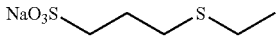

was produced by the following method:

| Formulation | |
|---|---|
| Sodium 3-mercaptopropane-1-sulphonate | 31.67 g |
| Sodium hydroxide | 7.25 g |
| Water | 86.8 g |
| Bromoethane | 19.75 g |
| Methanesulphonic acid 70% w/w | 1.10 g |

Method 2

The sodium hydroxide and 3-mercaptopropane-1-sulphonate were dissolved in 40 g of the water and transferred to a reaction flask equipped with heating, stirring and a reflux condenser. The mixture was heated to 60° C. Bromoethane was added dropwise from a dropping funnel over a period of 3 hours whilst maintaining the temperature at 60–70° C.

After complete addition of bromoethane, the temperature was slowly raised to 105° C. and maintained for 1 hour before the mixture was allowed to cool, during cooling the remaining water and methanesulphonic acid were added.

The crude liquid product of pH 6 was a 25% by weight solution of the target product and contained sodium bromide as a by-product.

A sample of crude product was purified as follows; the bromide ion was precipitated by the addition of a small excess of silver methanesulphonate and the solution filtered. An excess of sodium chloride was then added to the filtrate to precipitate the excess silver ions before repeating the filtration. The final clear product was a solution containing the product, sodium methanesulphonate and a small amount of sodium chloride.

The purified product is substantially free of unreacted sodium 3-mercaptopropane-1-sulphonate and bromide ions.

A plating bath was prepared containing 250 g/l of copper methanesulphonate, 30 g/l of methanesulphonic acid and 80 mg/l of chloride ions (added as hydrochloric acid). To this bath was added 100 mg/l of the product manufactured in method 2 (25 mg/l active material) and 100 mg/l of Pluriol P600 (polypropylene glycol MW 600), and 3 mg/l of 2-mercaptothiazoline. A test panel plated in this combination gave a hardness of 210 HV which did not self anneal on heating to 100° C. for 1 hour.

EXAMPLE 4

A compound having the following structure:

sodium 3-[(2-hydroxyethyl)sulfanyl]propane-1-sulphonate

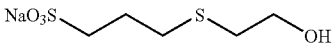

was produced by the following method:

| Formulation | |
|---|---|
| thiodiglycol | 21.8 g |
| Sodium hydroxide | 11.2 g |
| Water | 32.9 g |
| Propanesultone | 34.1 g |

Method 3

The sodium hydroxide was dissolved in the water and the thiodiglycol added. The mixture was then transferred to a reaction flask equipped with heating, stirring and a reflux condenser. The mixture was heated to 55° C. Propanesultone was added dropwise from a dropping funnel over a period of 1.5 hours whilst maintaining the temperature at about 60° C.

After complete addition of propanesultone, the temperature was maintained at 60° C. for a further 2 hours before allowing to cool.

The crude product was an approximately 60% by weight solution of the target product.

A sample of crude product was purified as follows: The majority of water was removed by a rotary evaporator under moderate vacuum at 60° C. The dried product was mashed well in ethanol before filtering. The collected solid was washed again in ethanol and finally diethyl ether before being filtered. The moist powder was then placed in an oven at 110° C. for 2 hours before grinding to a fine powder in a pestle and mortar. The dried and isolated product is then substantially free of residual thiodiglycol.

A plating bath was prepared containing 250 g/l of copper methanesulphonate, 30 g/l of methanesulphonic acid and 80 mg/l of chloride ions (added as hydrochloric acid). To this bath was added 25 mg/l of the purified product manufactured in method 3 and 100 mg/l of Pluriol P600 (polypropylene glycol MW 600), and 3 mg/l of 2-mercaptothiazoline. A test panel plated in this combination gave a hardness of 210 HV which did not self anneal on heating to 100° C. for 1 hour.

EXAMPLE 5

A compound having the following structure:

Disodium 3,3'-(butane-1,4-diyldisulfanediyl)propane-1-sulphonate

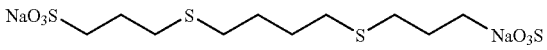

was produced by the following method:

| Formulation | |
|---|---|
| Sodium 3-mercaptopropane-1-sulphonate | 37.8 g |
| Sodium hydroxide | 8.6 g |
| Water | 102.9 g |
| 1,4-dibromobutane | 23.3 g |

Method 4

The sodium hydroxide and sodium 3-mercaptopropane-1-sulfonate were dissolved in 50.9 of the water and transferred to a reaction flask equipped with heating, stirring and a reflux condenser. The mixture was heated to 90° C. 1,4-dibromobutane was added dropwise from a dropping funnel over a period of 3 hours whilst maintaining the temperature at 90–1001° C.

After complete addition of 1,4-dibromobutane, the temperature was maintained at 100° C. for a further 1 hour before allowing to cool. During cooling a further 52 g of water were added to avoid precipitation of the product.

The crude liquid product was adjusted to pH 7 with approximately 0.5 g of 70% methanesulphonic acid. The crude product contains approximately 21% by weight of the target product and also contains sodium bromide as a by-product.

A sample of crude product was purified as follows; the bromide ion was precipitated by the addition of a small excess of silver methanesulphonate and the solution filtered. An excess of sodium chloride was then added to the filtrate to precipitate the excess silver ions before repeating the filtration. The final clear product was a solution containing the product, sodium methanesulphonate and a small amount of sodium chloride.

The purified product is substantially free of unreacted sodium 3-mercaptopropane-1-sulphonate and bromide ions.

A plating bath was prepared containing 250 g/l of copper methanesulphonate, 30 g/l of methanesulphonic acid and 80 mg/l of chloride ions (added as hydrochloric acid). To this bath was added 110 mg/l of the purified product manufactured in method 4 (24 mg/l active material) and 100 mg/l of Pluriol P600 (polypropylene glycol MW 600), and 3 mg/l of 2-mercaptothiazoline. A test panel plated in this combination gave a hardness of 210 HV which did not self anneal on heating to 100° C. for 1 hour.

EXAMPLE 6

A compound having the following formula:

Disodium 3,3-[oxybis(ethane-2,1-diylsulfanediyl)]dipropane-1-sulphonate

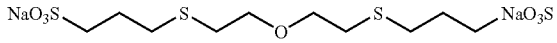

| Formulation | |
|---|---|
| 2-mercaptoethyl ether | 16.2 g |
| Sodium hydroxide | 9.6 g |
| Water | 43.5 g |
| Propanesultone | 30.1 g |

Method 5

The sodium hydroxide was dissolved in 16 g of the water and the 2-mercaptoethyl ether added. The mixture was then transferred to a reaction flask equipped with heating, stirring and a reflux condenser. The mixture was heated to 50° C. Propanesultone was added dropwise from a dropping funnel over a period of 1.5 hours whilst maintaining the temperature at 60–70° C. The product was formed as a precipitate.

After complete addition of propanesultone, the temperature was raised to 100° C. for a further 2 hours. At the higher temperature the product fully dissolved to give a clear reaction mixture. A further 27.5 g of water was added and the mixture was allowed to cool.

The crude clear reaction product is an approximately 50% by weight solution of the target product and is substantially free of unreacted sodium 3-mercapto-1-propanesulphonate.

A plating bath was prepared containing 250 g/l of copper methanesulphonate, 30 g/l of methanesulphonic acid and 80 mg/l of chloride ions (added as hydrochloric acid). To this bath was added 50 mg/l of the product manufactured in method 5 (25 mg/l active material) and 100 mg/l of Pluriol P600 (polypropylene glycol MW 600), and 3 mg/l of 2-mercaptothiazoline. A test panel plated in this combination gave a hardness of 210 HV which did not self anneal on heating to 100° C. for 1 hour.

It is also to be understood that the following claims are intended to cover all of the generic and specific features of the invention described herein and all statements of the scope of the invention which as a matter of language might fall therebetween.

What is claimed is:

1. A copper plating bath for depositing a copper layer onto a printing cylinder, the copper plating bath comprising:

a) a source of copper ions;

b) a source of methane sulphonate ions;

c) a source of chloride ions;

d) an organosulphur compound having the formula $R—S—R'—SO_3^-X^+$ or $X^+—O_3S—R'—S—R—S—R'—SO_3—X^+$, wherein R is alkyl, hydroxyalkyl or alkyl ether, R' is a $C_2$–$C_4$ alkyl group, and $X^+$ is a cation; and e) a polyether compound.

2. The copper plating bath according to claim 1, wherein the source of copper ions is copper methane sulphonate.

3. The copper plating bath according to claim 1, wherein the source of copper ions is present in the bath composition at a concentration of about 100–400 g/l.

4. The copper plating bath according to claim 1, wherein the source of methane sulphonate ions is methane sulphonic acid.

5. The copper plating bath according to claim 1, wherein the source of methane sulphonate ions is present in the bath composition at a concentration of about 5–100 g/l.

6. The copper plating bath according to claim 1, wherein the source of chloride ions is present in the bath composition at a concentration of about 10–200 mg/l.

7. The copper plating bath according to claim 1, wherein the organosulphur compound is present in the bath composition at a concentration of about 5–500 mg/l.

8. The copper plating bath according to claim 1, wherein the polyether compound is present in the bath composition at a concentration of about 5–5000 mg/l.

9. The copper plating bath according to claim 1, further comprising about 0.1 to 10 mg/l of a heterocyclic organosulphur compound.

10. The copper plating bath according to claim 9, wherein the heterocyclic organosulphur compound is 2-imidazolinethione or 2-mercaptothiazoline.

11. The copper plating bath according to claim 1, wherein $X^+$ in the organosulphur compound is selected from the group consisting of hydrogen, sodium, potassium, lithium, and combinations of one or more of the foregoing.

12. The copper plating bath according to claim 11, wherein $X^+$ is sodium.

13. The copper plating bath according to claim 11, wherein the organosulphur compound is selected from the group consisting of sodium 3-[(2-hydroxypropyl)sulfanyl]propane-1-sulphonate, sodium 3-(ethylsulfanyl)propane-1-sulphonate, sodium 3-[(2-hydroxyethyl)sulfanyl]propane-1-sulphonate, disodium 3,3'-(butane-1,4-diyldisulfanediyl)propane-1-sulphonate, and disodium 3,3-[oxybis(ethane-2,1-diylsulfanediyl)]dipropane-1-sulphonate.

14. The copper plating bath according to claim 1, wherein the polyether has the formula $HO(CH_2CH_2O)_x(CH(CH_3)CH_2O)_yH$, wherein x is between 0 to 1000 and y is between 0 to 5000, with the proviso that both x and y cannot be 0, and if x=0, then y is between 3 and 12 and if y=0, x is between 10 and 1000.

15. The copper plating bath according to claim 14, wherein the polyether is a block or random copolymer having a molecular weight of at least 1000.

16. The copper plating bath according to claim 15, wherein the compound is a 50/50 random copolymer of ethylene and propylene oxide.

17. A method of depositing a copper layer onto a printing cylinder at a high speed to produce a copper deposit having a stable hardness, the method comprising the steps of:

a) providing a copper plating bath comprising:

i) a source of copper ions;

ii) a source of methane sulphonate ions;

iii) a source of chloride ions;

iv) an organosulphur compound having the formula $R—S—R'—SO_3^-X^+$ or $X^+—O_3S—R'—S—R—S—R'—SO_3—X^+$, wherein R is alkyl, hydroxyalkyl or alkyl ether, R' is a $C_2$–$C_4$ alkyl group, and $X^+$ is a cation; and v) a polyether compound;

b) immersing the printing cylinder in the copper plating bath; and c) passing an electrical current through the copper plating bath while rotating the printing cylinder in the copper plating bath;

whereby copper is electrolytically deposited on the printing cylinder, said copper having a stable hardness.

18. The method according to claim 17, wherein the printing cylinder is fully immersed in the copper plating bath.

19. The method according to claim 17, wherein the printing cylinder is partially immersed in the copper plating bath.

20. The method according to claim 17, wherein the plated deposit has a Vickers hardness of 200–240 HV.

* * * * *